United States Patent [19]

Khandavalli

[11] Patent Number: 4,928,078

[45] Date of Patent: May 22, 1990

[54] BRANCH LINE COUPLER

[75] Inventor: Chandra Khandavalli, Fremont, Calif.

[73] Assignee: Avantek, Inc., Santa Clara, Calif.

[21] Appl. No.: 288,686

[22] Filed: Dec. 22, 1988

[51] Int. Cl.[5] ..... H01P 5/18

[52] U.S. Cl. ..... 333/109; 333/116

[58] Field of Search ..... 333/109, 114–117, 333/120, 123, 128

[56] References Cited

U.S. PATENT DOCUMENTS 3,772,616 11/1973 Imoto ..... 333/116 X

FOREIGN PATENT DOCUMENTS 1192000 11/1985 U.S.S.R. ..... 333/116

1339696 9/1987 U.S.S.R. ..... 333/120

*Primary Examiner*—Paul Gensler

*Attorney, Agent, or Firm*—Limbach, Limbach & Sutton

[57] ABSTRACT

A branch line coupler is disclosed. The device is comprised of multiple ports and branch lines, every two such lines being connected in a junction point. Each branch line has a width which is narrow at each end and increases in a curvilinear manner toward the middle. By virtue of the width design, the device performs the same functions as a conventional coupler, but for much higher frequencies.

8 Claims, 7 Drawing Sheets

$$S_{11} = \frac{j(B_{ca} - C_{fea})/2}{2A_{fe} + j(B_{ca} + C_{fea})} + \frac{j\ (B_{ca} - C_{foa})/2}{2A_{fo} + j(B_{ca} + C_{foa})}$$

$$S_{41} = \frac{j(B_{ca} - C_{fea})/2}{2A_{fe} + j(B_{ca} + C_{fea})} - \frac{j\ (B_{ca} - C_{foa})/2}{2A_{fo} + j(B_{ca} + C_{foa})}$$

$$S_{31} = \frac{2(A_{fo} - A_{fe}) + j(C_{foa} - C_{fea})}{[2A_{fe} + j(B_{ca} + C_{fea})]\ [2A_{fo} + j(B_{ca} + C_{foa})]}$$

$$S_{21} = \frac{2(A_{fo} + A_{fe}) + j(C_{foa} + C_{fea})}{[2A_{fe} + j(B_{ca} + C_{fea})]\ [2A_{fo} + j(B_{ca} + C_{foa})]}$$

FIG. 3A.

where:

$$A_{fe} \times \Gamma^2 = \Gamma^2\cosh^2\Gamma l + (3\gamma^2 - \delta^2/4)\sinh^2\Gamma l$$

$$B_{ca} \times \Gamma^2 = 2\kappa\gamma\sinh\Gamma l(\Gamma\cosh\Gamma l - (\delta/2)\sinh\Gamma l)$$

$$C_{fea} \times \Gamma^2 = \frac{\gamma\sinh\Gamma l[4\Gamma^2\cosh^2\Gamma l + (4\gamma^2 - \delta^2)\sinh^2\Gamma l]}{\kappa(\Gamma\cosh\Gamma l - (\delta/2)\sinh\Gamma l)}$$

$$A_{fo} \times \Gamma^2 = 3\Gamma^2\cosh^2\Gamma l + (\gamma^2 - 3\delta^2/4)\sinh^2\Gamma l$$

$$C_{foa} \times \Gamma^2 = \frac{4(\Gamma\cosh\Gamma l + (\delta/2)\sinh\Gamma l)[\Gamma^2\cosh^2\Gamma l + (\gamma^2 - \delta^2/4)\sinh^2\Gamma l]}{\kappa\gamma\sinh\Gamma l}$$

with:

$\Gamma = j\beta_{ge} = j2\pi/\lambda_{ge}$, where $\lambda_{ge}$ = guide wavelength of the exponential line $\gamma = j\beta_{gu} = j2\pi/\lambda_{gu}$, where $\lambda_{gu}$ = guide wavelength of the uniform line $\delta$ = rate of exponential taper $\kappa$ = impedance of arm at junction $2l$ = length of each arm

FIG. 3B

COUPLING FACTOR AS A FUNCTION OF NORMALIZED FREQUENCY.

PHASE AS A FUNCTION OF NORMALIZED FREQUENCY.
PHASE AT PORT 2 WITH RESPECT TO PORT 3, FEEDING AT PORT 1.

ISOLATION AS A FUNCTION OF NORMALIZED FREQUENCY.

INPUT VSWR AS A FUNCTION OF NORMALIZED FREQUENCY.

BRANCH LINE COUPLER

FIELD OF THE INVENTION

This invention is in the area of microwave couplers. It relates to Branch Line Couplers which may be of stripline, microstrip, coaxial, waveguide or monolithic type. More specifically, the invention relates to an advance in the design of said couplers resulting in increased performance.

BACKGROUND

One of the simplest and least expensive methods of microwave power division and directional coupling is by the direct coupled or branch line type of structure. This method of construction is particularly suitable to a single plane configuration and has the advantage of dc continuity. The simplest of branch line couplers is the two section version shown in FIG. 1*a*. It consists of a mainline which is coupled to a secondary line by two quarterwave-long sections spaced one quarter wavelength apart. Thus, it has a circumference of approximately one wavelength. The coupling factor is determined by the ratios of the impedances of shunt and series branch arms and it is adjusted to maintain a proper match over frequency. The impedance ratios necessary for proper coupling are widely known. See for example, H. Howe Jr.; "Stripline Circuit Design," Chapter 3, Artech House, Inc.

Some practical applications of branch line couplers include: 1. Power division for image rejection mixers and single sideband modulators; 2. Circuits requiring reflection of mismatches into a terminated fourth port load.

In a typical design, for example, a 3 dB branch line coupler for operation in a 50 Ohm system, the series arms are of 35.4 Ohm characteristic impedance. The shunt arms are of 50 Ohm characteristic impedance. In this case, a signal incident at port 1 divides equally between ports 2 and 3 with a 90 degree phase difference and port 4 remains isolated.

A major problem with branch line couplers arises at high frequencies. Since wavelength is inversely proportional to frequency, branch line couplers designed for high frequency operation will have shorter arm lengths but the arm widths are unchanged. See FIG. 1b. Thus, the length of the line approaches its width such that there is a relatively large junction point which consists of merged and nondistinct lengths and widths for the branch lines. This translates into a large junction discontinuity, severely affecting the microwave performance of the device. Numerous reports have dealt with how to analyze and to compensate the junction discontinuity reactance, but not how to reduce the same. See for example, (1) R. Mehran: "Compensation of microstrip bends and Y-junctions with arbitrary angle," IEEE transactions on Microwave Theory and Techniques, vol. MTT-26, pp. 400–405, June 1978; (2) R. Chadha and K.C. Gupta: "Compensation of Discontinuities in Planar Transmission Lines," IEEE transactions on Microwave Theory and Techniques, vol. MTT-30, pp. 2151–2155, Dec. 1982. A major advance would thus be represented where a localized junction between branch arms could be designed such that there are distinct arm lengths and widths at high frequencies. Gaining such a control over the junction size has important implications in all microwave circuits, particularly in monolithic integrated circuits.

SUMMARY OF THE INVENTION

The present invention is for a Branch Line Hybrid Coupler with branch arms which are wide in the middle and narrow at each end, such that the junction point of the arms is very localized, resulting in minimized reactance. In one embodiment, the use of exponential functions to describe the design of branch arms results in performance which exceeds conventional designs at high frequencies.

It is therefore an object of the present invention to provide a coupler having arms of a reasonable size but still has minimized parasitic reactance for high frequency applications.

The foregoing and other objectives, features and advantages of the invention will be more readily undestood upon consideration of the following detailed description of certain preferred embodiments of the invention, taken in conjunction with the accompanying drawings.

DESCRIPTION OF THE DRAWINGS

FIG. 3 illustrates the S-parameter equations which describe the disclosure.

DETAILED DESCRIPTION OF THE DISCLOSURE

Figure 1A:
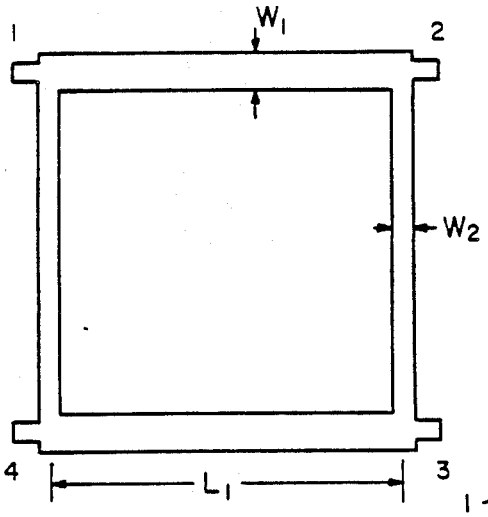
(PRIOR ART) FIG. 1(a)
FIGS. 1A and B illustrate conventional coupler designs.
Figure 1B:
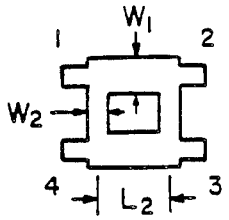
(PRIOR ART) FIG. 1(b)
Figure 2:
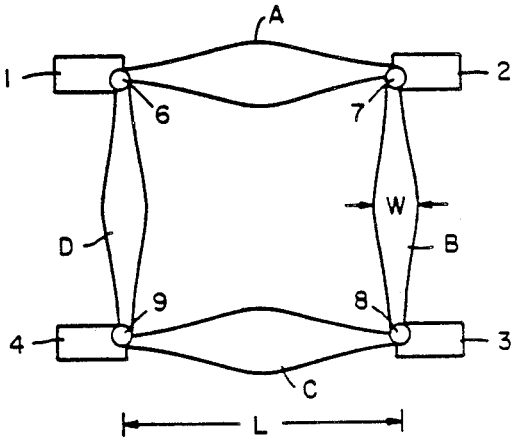
FIG. 2 illustrates one embodiment of a 4-port coupler in accordance with the invention.

A schematic representation of one embodiment of a branch line hybrid coupler with exponentially tapered arms is set forth in FIG. 2. The general configuration of the invention consists of a plurality of branch lines, each branch line being wide in the middle and thinning in a curvilinear manner toward the end, at least two such branch lines being connected at a junction point. The circuit shown in FIG. 2 resembles a conventional two-branch, four-port hybrid circuit. The ports of the coupler are labeled 1, 2, 3 and 4. Each port is an isolated connection point for input and output signals. Each port is connected in a loop by branch line arms. The arms are connected on the inside edge of the port at a highly localized junction point. The arms are labeled A, B, C, and D. Arms A and D meet at junction point 6. Arms A and B meet at junction point 7. Arms B and C meet at junction point 8. Arms C and D meet at junction point 9.

The arm length, L, may be varied in order to achieve the desired coupling factor. In accordance with the invention, the characteristic impedance $Z_0$ of each arm is designed to be exponentially decreasing over half its length, then exponentially increasing over the second half of its length. $\Gamma$ is the propagation constant and is dependent on $\lambda_{ge}$, the guide wavelength of the exponential line. ↓ is the propagation constant and is dependent on $\lambda_{gu}$, the guide wavelength of the uniform line. $\delta$ is the rate of exponential taper. $\kappa$ is the impedance of the arm at the junction. The exponential function $Z=\kappa \exp(-\delta L)$ describes the impedance of the line along its length up to the center of the arm. Each arm is built of two exponentially varying taper sections connected back to back. By selecting a taper =0, line width is uniform, as in a conventional hybrid coupler.

Figure 4:
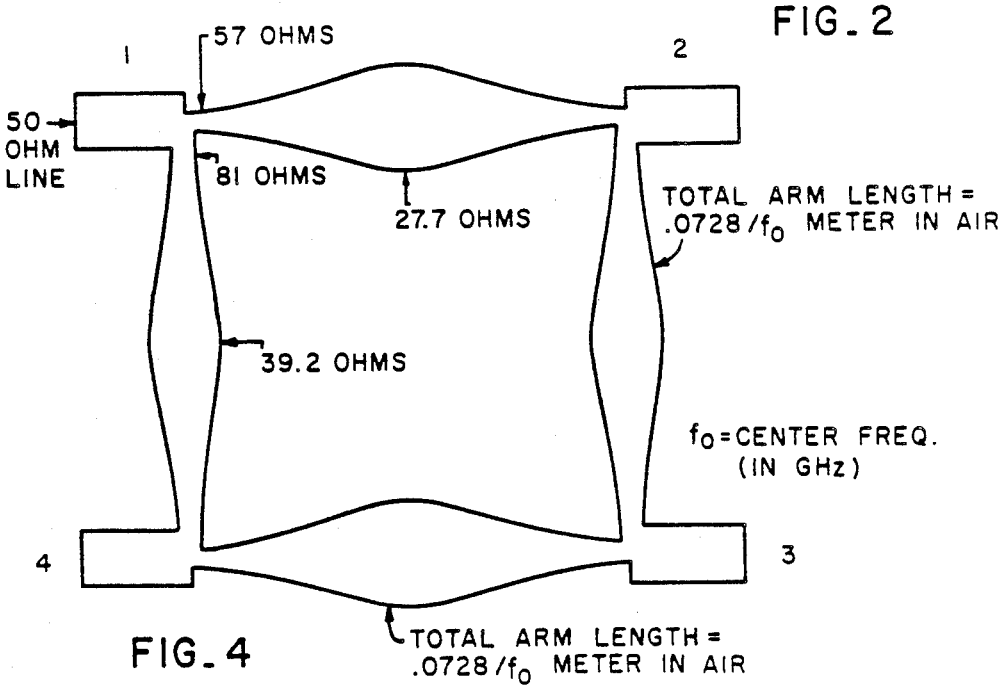
FIG. 4 illustrates a 3 db embodiment of the disclosure.

FIG. 3 illustrates the S-parameter equations which describe the invention. The four port network of FIG. 4 can be completely described by sixteen S parameters. These are $S_{11}$, $S_{12}$, $S_{13}$, $S_{14}$, $S_{21}$, $S_{22}$, $S_{23}$, $S_{24}$, $S_{31}$, $S_{32}$, $S_{33}$, $S_{34}$, $S_{41}$, $S_{42}$, $S_{43}$ and $S_{44}$. From the symmetry of the structure it is clear that:

$$S_{11}=S_{22}=S_{33}=S_{44}$$

$$S_{21}=S_{12}=S_{34}=S_{43}$$

$$S_{31}=S_{13}=S_{24}=S_{42}$$

$$S_{41}=S_{14}=S_{32}=S_{23}$$

Thus, the structures are completely described by determining $S_{11}$, $S_{12}$, $S_{13}$, $S_{14}$. FIG. 3 presents the equations describing these four S parameters. In determining FIG. 3, $j=\sqrt{-1}$.

The advantage of the invention can be seen at high frequencies. Whereas in a conventional design the length and width of the branch lines merge to form a large junction with high, undesirable reactances, the present invention provides a small localized junction such that arm length may remain long relative to the size of the junction. The widening of the branch lines in a curvilinear manner away from the junction decreases the impedance of the branch. The narrowing of the branch approaching the junction provides an increasing impedance. By selecting high impedances at the junction, parasitic reactance is minimized, as is apparent in FIG.4.

Complete performance data of a branch line coupler designed according to the present invention is represented in FIGS. 5–8.

Figure 5:
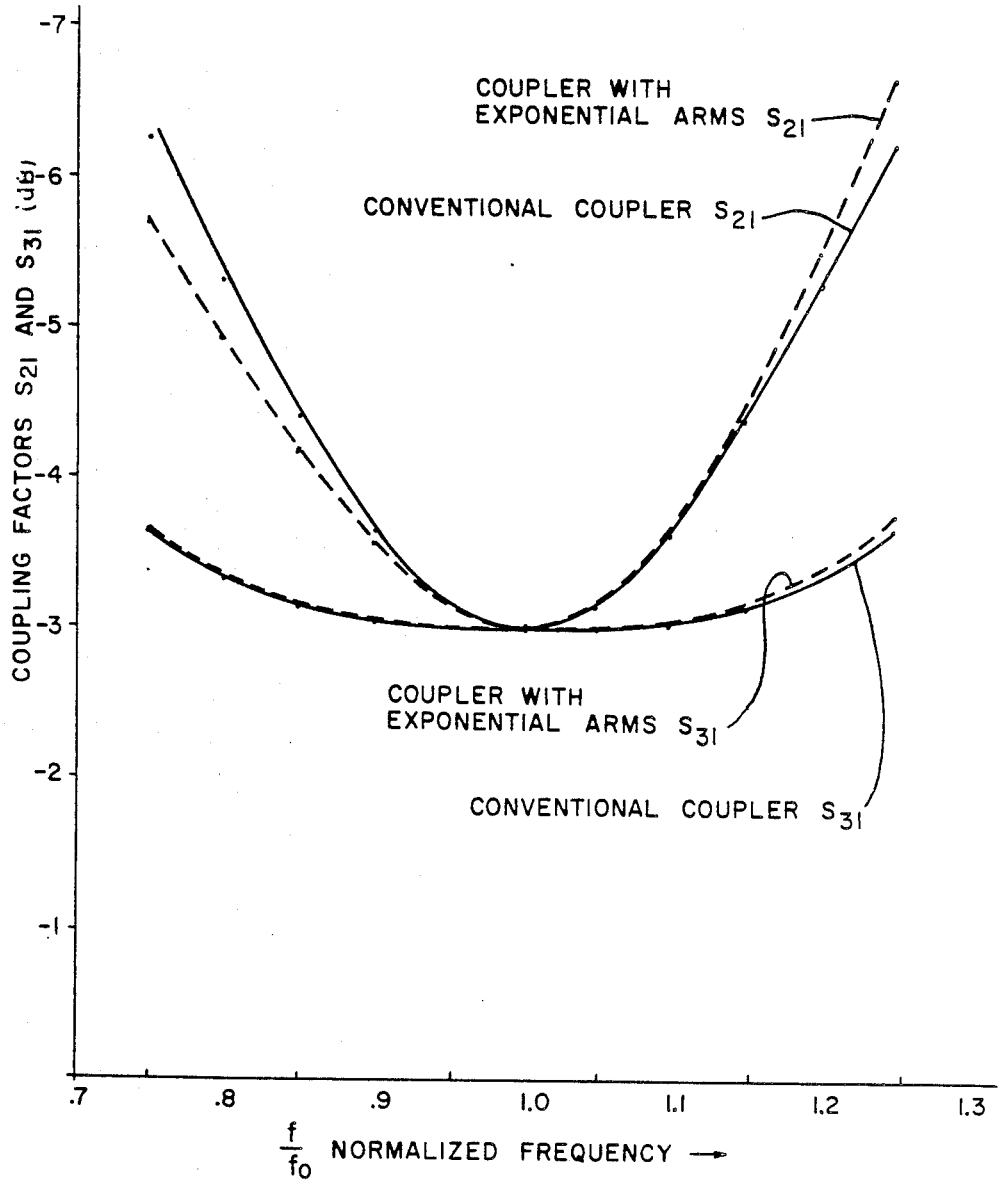
FIG. 5 illustrates coupling factor performance curves for explaining the operation of the invention.

FIG. 5 shows the coupling performance for typical S-parameters, $S_{31}$ and $S_{41}$. The performance of a conventional design is shown by a solid line while the performance for the invention is shown by a dotted line.

Figure 6:
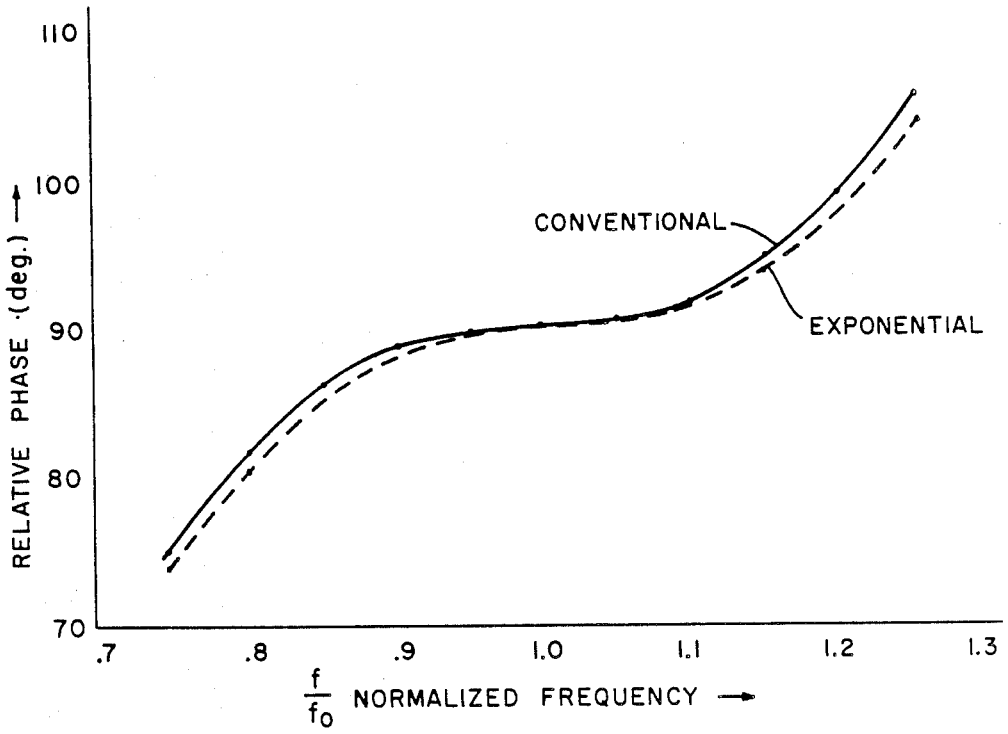
FIG. 6 illustrates phase response performance curves for explaining the operation of the invention.

FIG. 6 shows the phase response comparison between a conventional design and the invention. The performance of the conventional design is shown by a solid line while the performance for the invention is shown by a dotted line.

Figure 7:
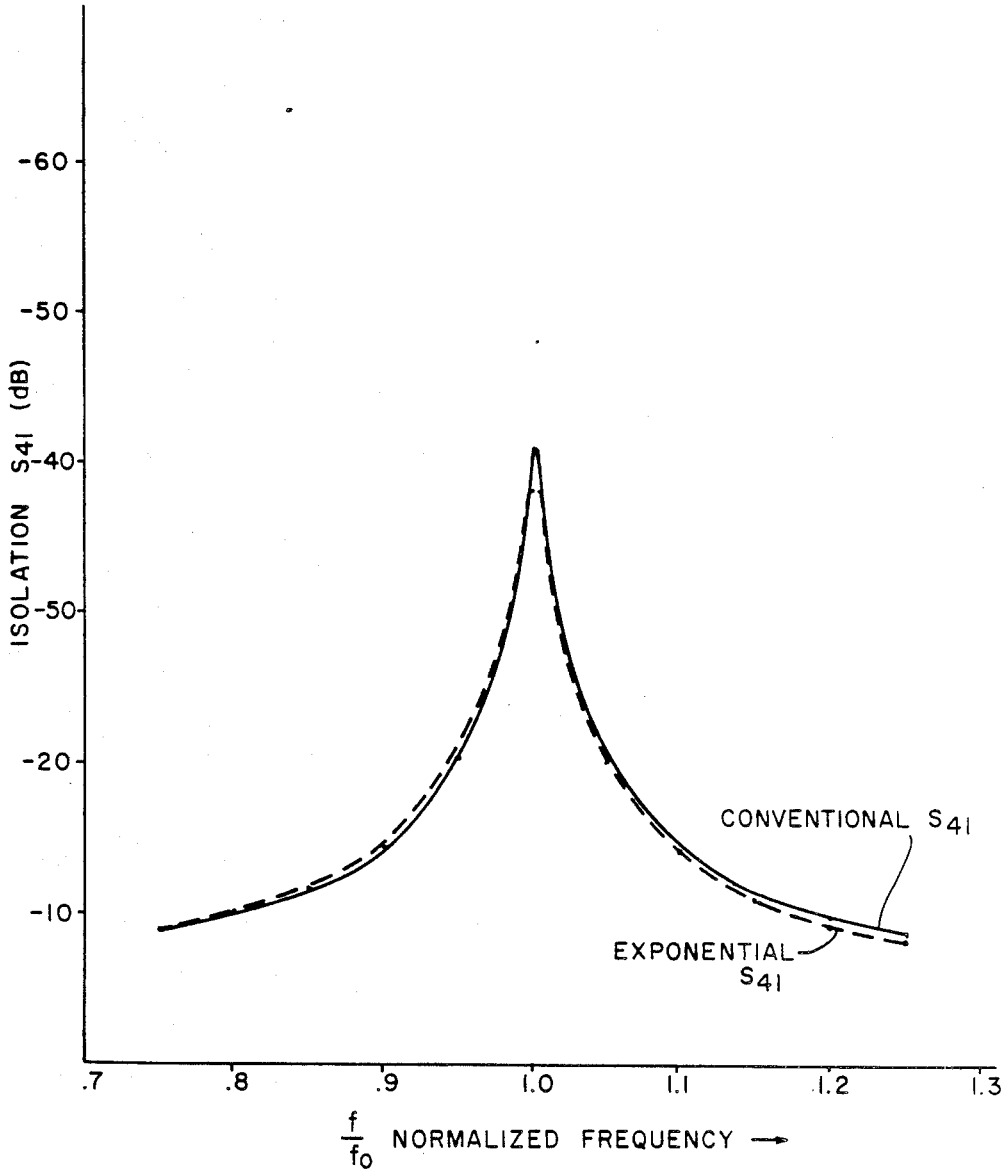
FIG. 7 illustrates isolation performance curves for explaining the operation of the invention.

FIG. 7 shows the isolation curve comparison. The performance of a conventional design is shown by a solid line while the performance for the invention is shown by a dotted line. Both designs show similar response.

Figure 8:
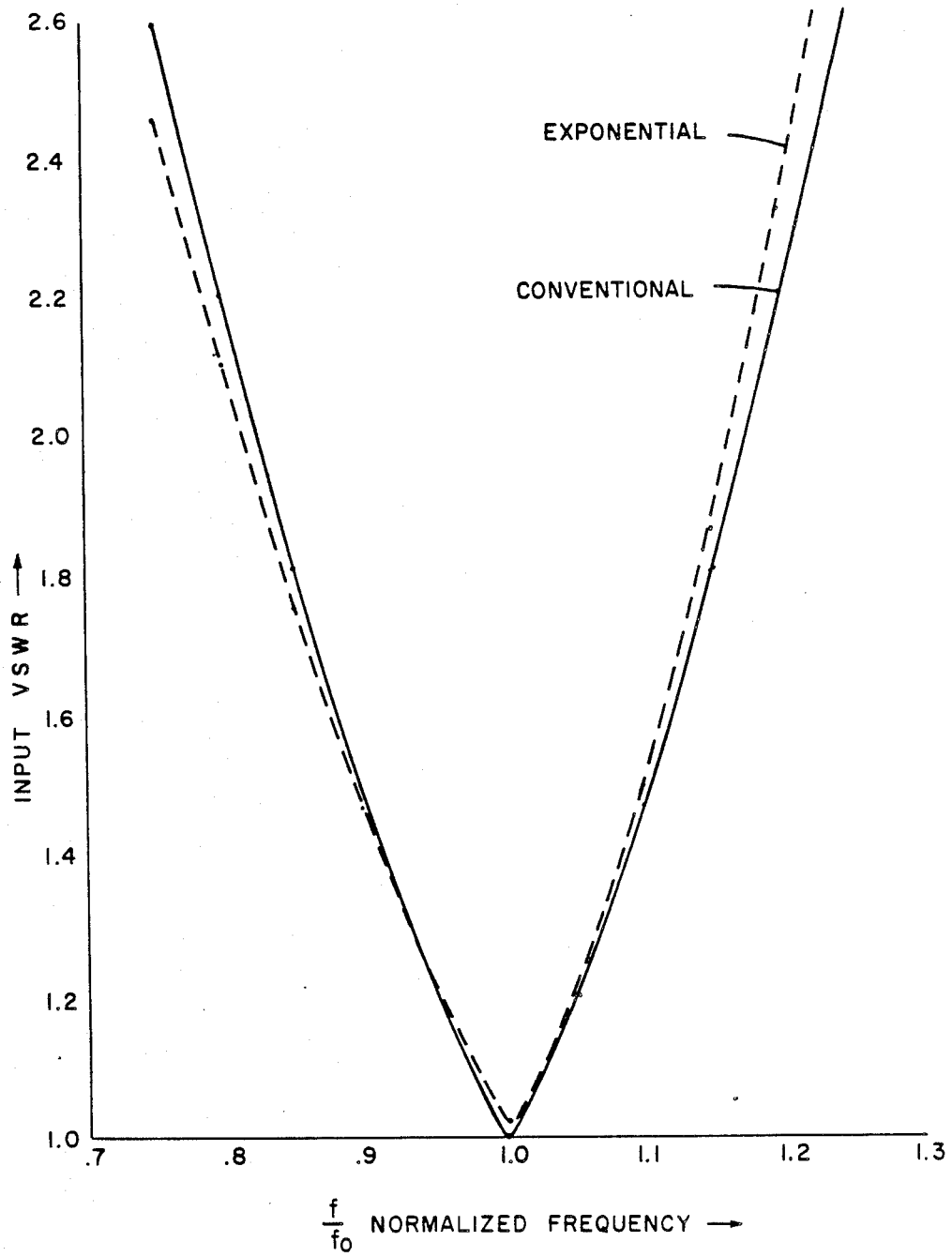
FIG. 8 illustrates input match performance curves for explaining the operation of the invention.

FIG. 8 shows the input match voltage characteristics. The performance of a conventional design is shown by a solid line while the performance for the invention is shown by a dotted line.

Although the present invention has been shown and described with respect to preferred embodiments, various changes and modifications which are obvious to a person skilled in the art to which the invention pertains are deemed to lie within the spirit and scope of the invention.

I claim:

1. A branch line coupler for transmission line signal conditioning of the type having a plurality of branch line coupler arms connected at a junction point, each said branch line coupler arm having a substantially linear shape including a middle and two ends, wherein the improvement comprises each said branch line coupler arm thinning in a curvilinear manner from the middle toward each end.

2. The branch line coupler according to claim 1 in which each branch line coupler arm consists of two exponentially tapered sections connected back to back.

3. The branch line coupler according to claim 1 which is built in a stripline configuration.

4. The branch line coupler according to claim 1 which is built in a planar configuration.

5. The branch line coupler according to claim 1 wherein the number of branch lines is two for dividing an incoming signal to the junction point into two parts with a 90 degree phase difference.

6. A branch line coupler comprising multiple ports and branch line coupler arms, each branch line coupler arm having two ends and a middle, every two such branch line coupler arms being connected at a junction point and each branch line coupler arm having a width which increases in a curvilinear manner from each of the ends toward the middle of the branch line.

7. The branch line coupler according to claim 6 wherein four such branch line coupler arms are connected together in a generally rectangular configuration.

8. The branch line coupler according to claims 2 or 7 wherein a length of each branch line coupler arm is a predetermined function of a desired coupling factor and a characteristic impedance of each branch line coupler arm exponentially decreases over half of the length of the branch line coupler arm from one end and then exponentially increases over the remaining half of the branch line coupler arm's length.

* * * * *

UNITED STATES PATENT AND TRADEMARK OFFICE

CERTIFICATE OF CORRECTION

PATENT NO. : 4,928,078

DATED : May 22, 1990

INVENTOR(S) : Chandra Khandavalli

It is certified that error appears in the above - identified patent and that said Letters Patent is hereby corrected as shown below:

In Column 3, Line 1, replace "ϟ" with --γ--.

Signed and Sealed this

Twenty-seventh Day of August, 1991

*Attest:*

HARRY F. MANBECK, JR.

*Attesting Officer*

*Commissioner of Patents and Trademarks*